US009157271B2

(12) United States Patent
Burton

(10) Patent No.: US 9,157,271 B2
(45) Date of Patent: Oct. 13, 2015

(54) SPLINE FOR SCREEN FRAMING

(75) Inventor: Lance Burton, Mentor, OH (US)

(73) Assignee: Burton, Fastener Distributing LLC, Mentor, OH (US)

( * ) Notice: Subject to any disclaimer, the term of this patent is extended or adjusted under 35 U.S.C. 154(b) by 83 days.

(21) Appl. No.: 13/118,375

(22) Filed: May 28, 2011

(65) Prior Publication Data

US 2012/0297587 A1 Nov. 29, 2012

(51) Int. Cl.
*E04F 21/00* (2006.01)
*E06B 9/24* (2006.01)

(52) U.S. Cl.
CPC ..... *E06B 9/24* (2013.01)

(58) Field of Classification Search
USPC ..... 24/459–462; 160/391, 392, 394, 395, 160/397, 403; 52/202, 222, 63
See application file for complete search history.

(56) References Cited

U.S. PATENT DOCUMENTS

| | | | | | |
|---|---|---|---|---|---|
| 2,978,022 | A | | 2/1955 | Winnan | |
| 2,897,889 | A | | 5/1957 | Kessler | |
| 3,187,801 | A | * | 6/1965 | Saling | 160/392 |
| 4,133,367 | A | * | 1/1979 | Abell | 160/368.1 |
| 4,233,790 | A | * | 11/1980 | Meadows | 52/222 |
| 4,467,504 | A | * | 8/1984 | Quist | 24/462 |
| 4,662,038 | A | * | 5/1987 | Walker | 24/460 |
| 4,799,299 | A | * | 1/1989 | Campbell | 24/462 |
| 5,046,546 | A | * | 9/1991 | Benedyk et al. | 160/371 |
| 5,380,120 | A | * | 1/1995 | Vermeulen | 52/63 |
| 5,547,249 | A | * | 8/1996 | Riley et al. | 297/228.13 |
| 2006/0231221 | A1 | * | 10/2006 | Chen | 160/392 |

FOREIGN PATENT DOCUMENTS

| | | | | |
|---|---|---|---|---|
| DE | 10163891 | A1 * | 7/2003 | A45F 3/52 |
| FR | 2575243 | A1 * | 6/1986 | E04H 15/64 |

OTHER PUBLICATIONS

Document: EZ Spline webpage 8-24-11.pdf, From URL http://ez-spline.com/, EZ Spline, LLC., "Welcome to ez-Spline Online", May 25, 2011 (printed Aug. 24, 2011), p. 1, EZ Spline, LLC., Mentor, OH, Note instructional video presented at this URL.

Document: Background for screen spline webpage.pdf, from URL http://www.all-about-screen-doors.com/spline.html, All About Screen Doors and Screen King, "Spline, how to buy and how to use it", May 27, 2011 (printed Aug. 24, 2011), pp. 1-5, All About Screen Doors and Screen King, Niagara Falls, New York.

* cited by examiner

*Primary Examiner* — Robert J Sandy
(74) *Attorney, Agent, or Firm* — D.A. Stauffer Patent Services LLC

(57) ABSTRACT

A dual composition spline for screen framing adds a stabilizing top plate to a round spline body for improved ease of installation using a wide flat roller. The plate is generally rectangular and is made of a relatively high Durometer material, which makes it much harder than the usual material used in screening splines. The holding portion (body) is more like a typical round spline with a relatively low Durometer material which is resilient to hold the screen in a frame channel. The plate and body are connected lengthwise to make a unitary spline.

4 Claims, 7 Drawing Sheets

SPLINE FOR SCREEN FRAMING

TECHNICAL FIELD OF THE INVENTION

The present invention relates to window screen fastening and, more particularly to splines for holding screening in a groove of a frame.

BACKGROUND OF THE INVENTION

A common type of prior art window screen, usually having an aluminum frame, has a channel in the frame along all four sides of the screened area. Referring to Prior art illustrations in FIGS. 1, 4A and 4B, when a screen is framed to make an assembled window screen, screening material 20 is positioned with the edges extending across and a bit beyond the outside edge of the channel 28. Then a flexible, resilient "spline" 10 with a generally circular cross section is pressed down into the channel and it pushes the edge of the screening down in with it. Since the spline has a body diameter Wb that is comparable to, or slightly larger than, the width We of the channel, and is resilient, it will hold the screening in place by squeezing it between the spline and the inside wall(s) of the channel, thereby creating a frictional holding or gripping force to resist pull-out of the screening. This holding force needs to be of sufficient magnitude to hold the screening in tension across the frame so as to make it uniformly flat, not wavy or wrinkled or floppy. As seen in FIG. 1, the prior art spline 10 typically has short longitudinal ribs 14 spaced apart around the circumference of the spline's body. The ribs are formed along with the body (e.g., by extrusion) out of the same resilient material as the rest of the spline and they provide easily deformed resilient grippers. Since the ribs add to the nominal diameter of the spline body they add extra resilient spring-back pressure against the channel walls thereby increasing frictional resistance to the spline being pulled back upward and out of the channel. As shown, the body 12 may be hollow (center axial hole 16) for providing easier compressibility.

A problem with the prior art is that the spline is difficult to push down into the channel properly. It is long and squirmy, and cannot be longitudinally "rubbed" into place since the resilient material has a relatively high coefficient of friction. Furthermore, due to its flexibility, it is difficult to press into place in a way that provides a uniform tension on the screening at all points around the perimeter of the screen. This is most problematic if an inexperienced person is trying to press the spline into place by hand. This problem is reduced, but not eliminated, by using a special-purpose spline roller 62 installation tool. Like a "pizza-cutter", the tool includes a rotatable wheel on a handle. On better quality tools the wheel may have a pulley-like groove around its circumference to help the user keep the tool on top of the round spline body. The tool is placed on the spline and is pushed downward and forward to force the spline into the channel a little bit at a time as it is rolled along the spline above the channel. Tension on the screening now depends upon the user being able to maintain a uniform and adequate downward force on the tool while also maintaining a uniform forward speed that is adequate to allow time for the spline to be pressed downward before moving on to the next incremental length portion of the spline. Also, if not advanced in line with the channel, then the wheel will roll off the top of the spline, thus interrupting a uniform installation, and often cutting the screen. The same problem occurs if the squirmy spline is not held in line with the channel. Furthermore, the diameter of the spline varies inversely with the amount of stretching force applied to it as the user pulls it out straight ahead of the installation tool. This, of course, further adds variability to the tension and gripping force of the installed spline 10.

A further problem with the prior art splines is that proper installation means that the spline should be pressed down into the channel below the surface of the frame. This can only be done by using a pushing tool, such as the pizza cutter style spline roller 62, that is narrower than the channel width Wc. Using such a tool requires carefully controlled pressure exerted by the installer in a direction carefully aligned with the channel, which is hard on the wrist, because otherwise the thin roller easily rolls off the round spline and can cut the screen.

Thus an object of the present invention is to overcome many of the above described deficiencies and limitations of the prior art splines, installation methods, and/or installation tools.

BRIEF SUMMARY OF THE INVENTION

A dual composition spline for screen framing adds a stabilizing top plate to a round spline body for improved ease of installation using a wide flat roller. The plate is generally rectangular and is made of a relatively high Durometer material, which makes it much harder than the usual material used in screening splines. The holding portion (body) is more like a typical round spline with a relatively low Durometer material which is resilient to hold the screen in a frame channel. The plate and body are connected lengthwise to make a unitary spline.

According to the invention, a spline for screen framing, wherein a frame has a longitudinal channel in the face of a frame member, the channel having a width (Wc) and a depth (Dc), and a portion of screen is removably held within the channel by a spline; the spline comprising: an elongated member having a longitudinally extending holding portion (body) connected along its length to an adjacent longitudinally extending stabilizing portion (top, or plate); wherein the holding portion is resiliently compressible laterally across its width (Wb), being a first material composition with a first degree of hardness; and the stabilizing portion comprises a second material composition with a second degree of hardness that is greater than the first degree of hardness.

Further according to the invention:

shapes contribute to performance (rectangular plate shape on top of spline helps make the second material even more rigid and more twist resistant. Added thickness helps, plus makes less extensible.)

(The ribbed body makes it more compressible, and the optional hole in center makes it even more so.)

Preferred dimensions relative to channel:

(stabilizer/plate is thick enough to push spline down to correct installation depth, and is uniform because of using flat roller that stops on face of frame member)

(rectangular plate centers and fills channel for good appearance)

(spline body is nominally wider than channel for good holding)

Dual Material Composition Characteristics:

Body is optimized for holding screen in channel, using a soft, resilient material composition, e.g., plastic material that is less than 100 Durometer, preferably about 70-80 Durometer vinyl (or PVC).

The plate is optimized to be a stabilizing element, having characteristics designed to counteract instability during installation such as squirming, twisting, stretching and thinning, and increasing frictional resistance. To accomplish this, first of all we changed the material composition of the plate to a much harder material (e.g., 2 to 3 times harder) than the body material. Then the stabilization characteristics are enhanced by dimensional and shape choices. Thus the plate is made from a relatively high Durometer material, such as about 200 Durometer (generally, it is greater than the soft, resilient 70-80 Durometer vinyl material used for the body).

Stabilizer/Top Plate:

Preferably UV resistant material since exposed at top of channel.

It gives a finished look to channel, filling it and making surface level with face of frame member surrounding the channel It provides a good screen trimming guide It enables installation with a wide flat roller that is much easier because doesn't have to be aligned with channel, and stops at uniform installation depth when roller hits face of frame member, meaning that the plate is flush with the face.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different versions of an element 109 which are similar or related in some way but are separately referenced for the purpose of describing modifications to the parent element (109). Such relationships, if any, between similar elements in the same or different figures will become apparent throughout the specification, including, if applicable, in the claims and abstract.

Figure 1:
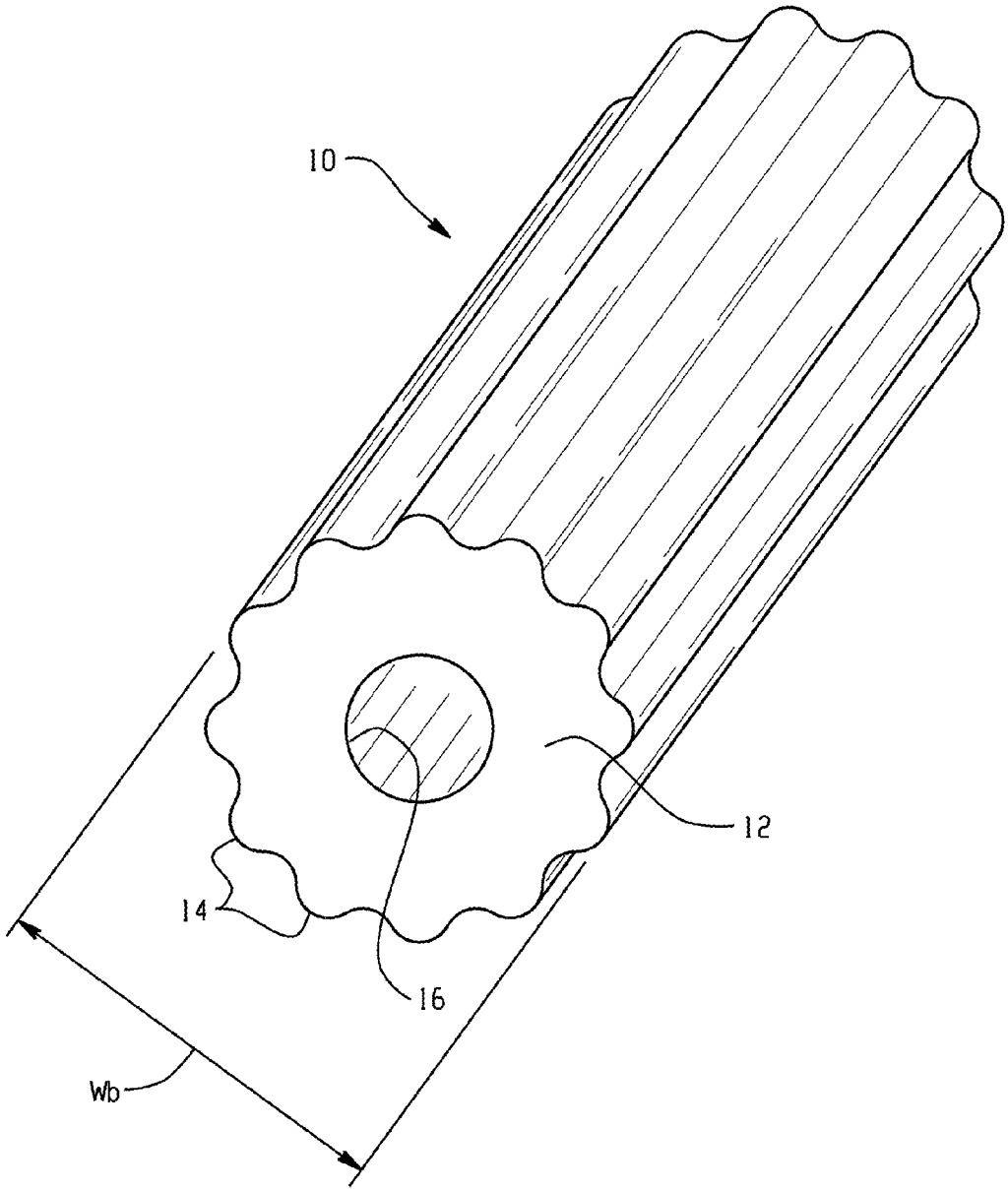
Fig. 1 PRIOR ART

The structure, operation, and advantages of the present preferred embodiment of the invention will become further apparent upon consideration of the following description taken in conjunction with the accompanying drawings, wherein:

FIG. 1 is a perspective view of a prior art spline.

Figure 2:
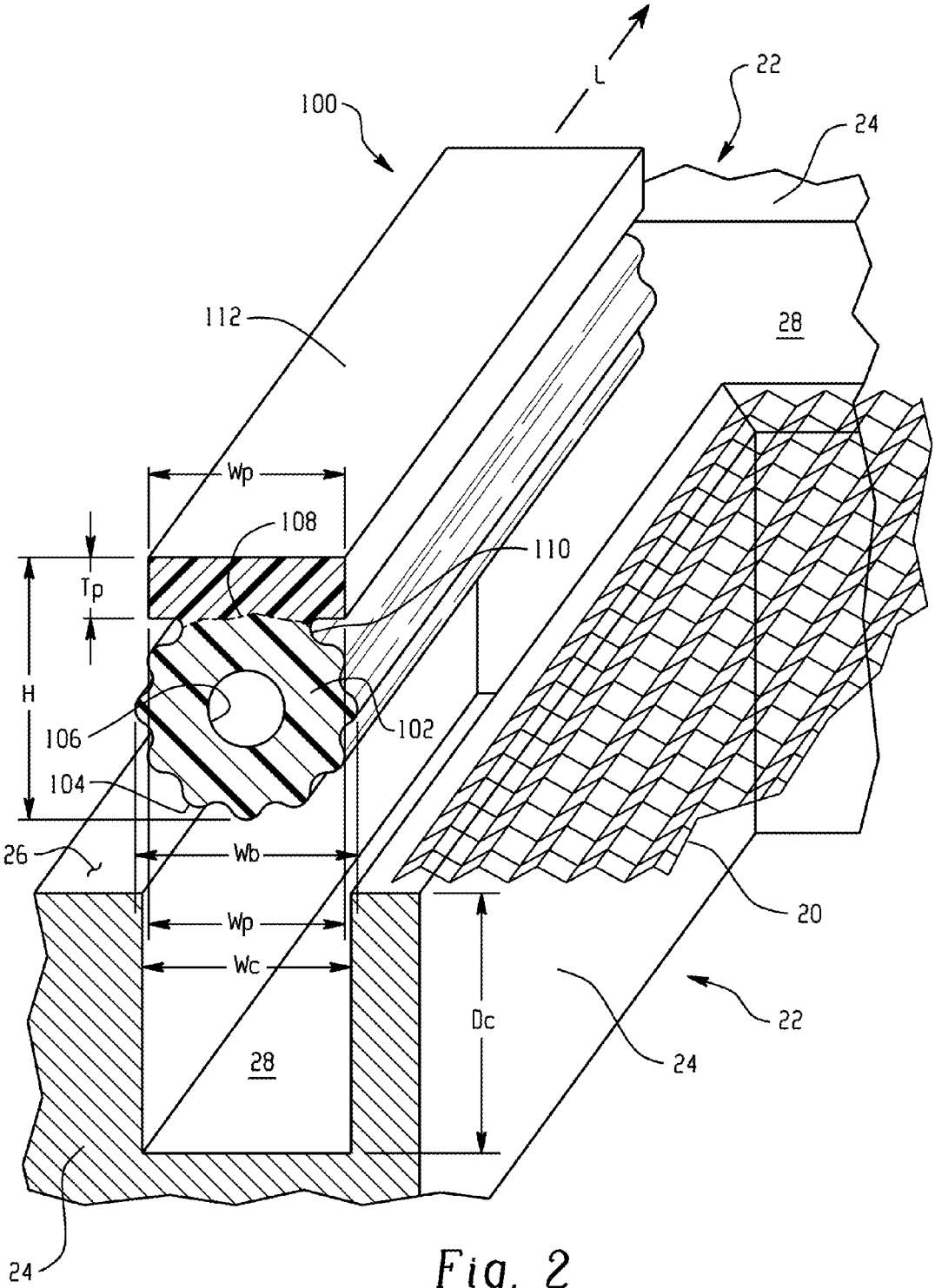

FIG. 2 is a perspective view of a dual composition spline according to the invention.

Figure 3:
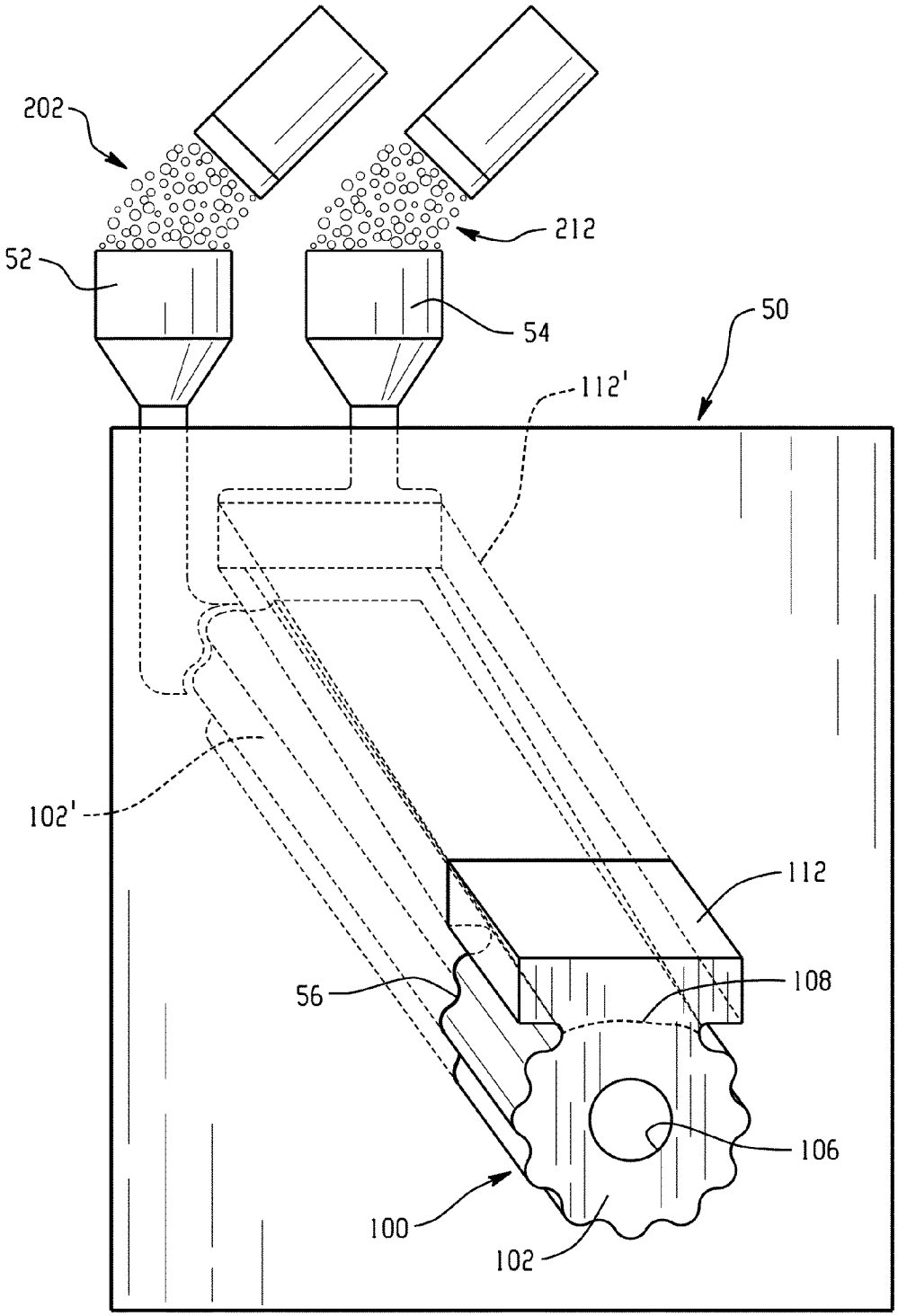

FIG. 3 is a schematic perspective view of the spline of FIG. 2 being manufactured in a suitable process, according to the invention.

Figure 4A:
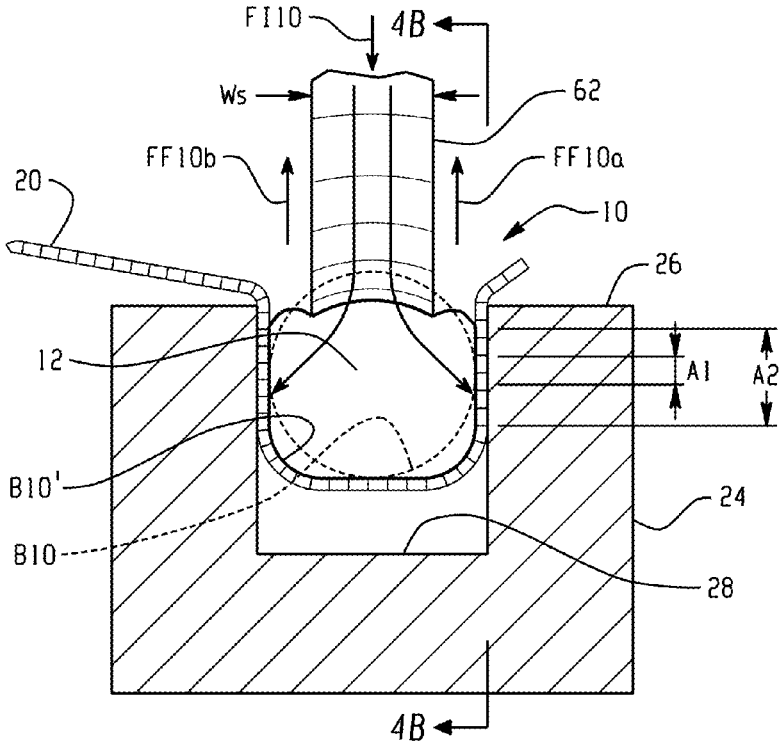
Fig. 4A PRIOR ART
Figure 4B:
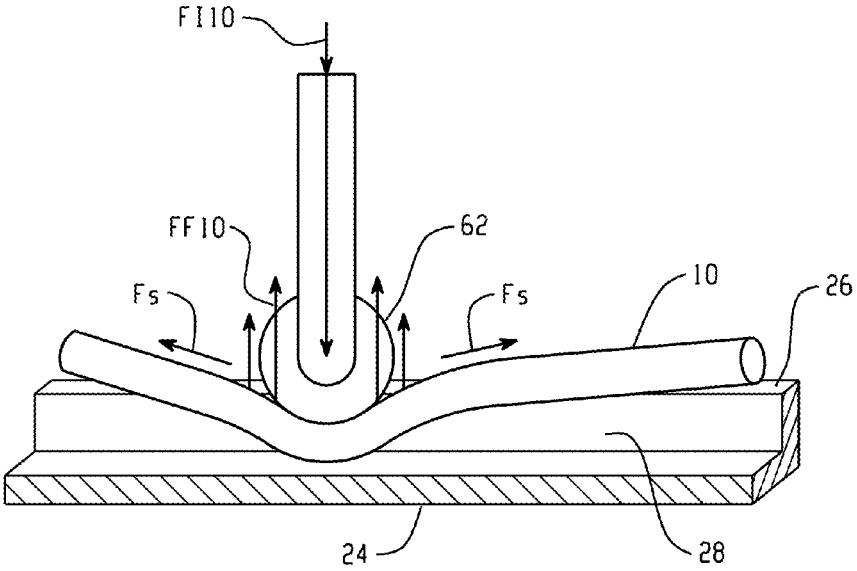
Fig. 4B PRIOR ART

FIGS. 4A-4B are end and side cross-sectional views, respectively, illustrating a prior art spline being installed (screening not shown).

Figure 5A:
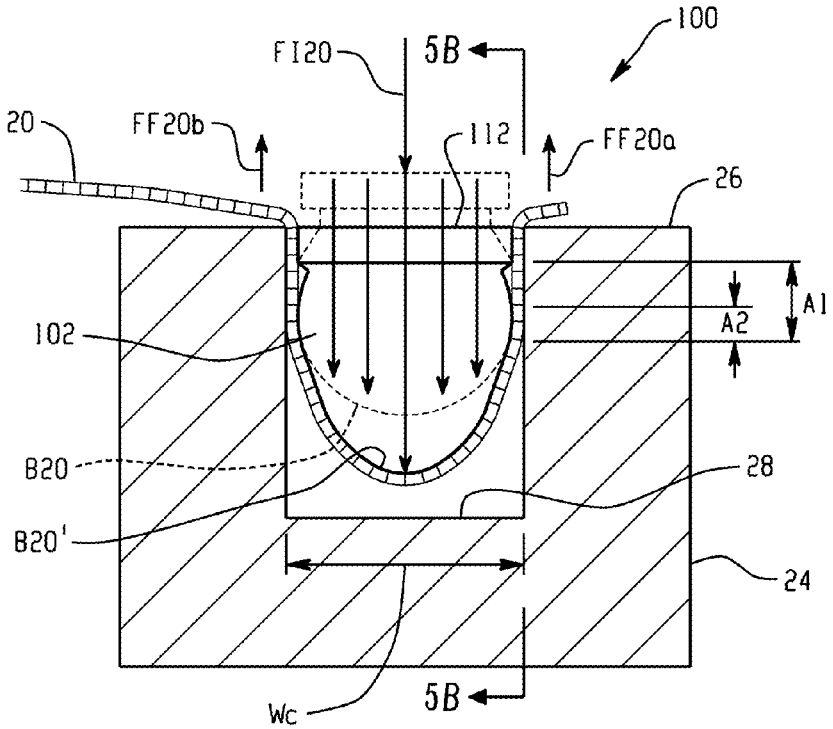
Figure 5B:
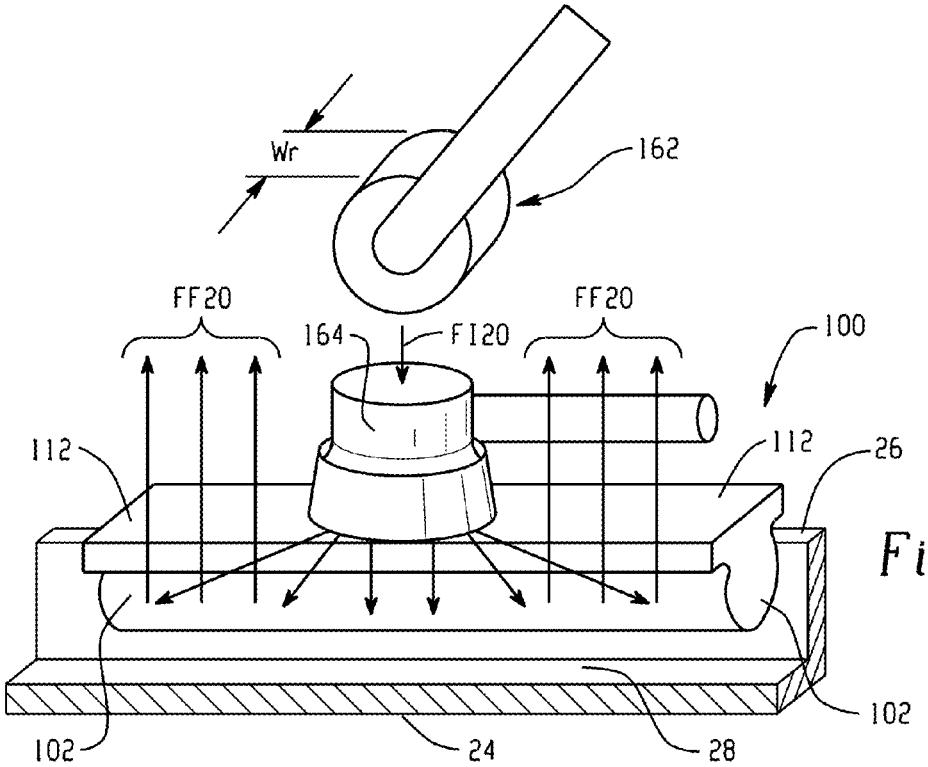

FIGS. 5A-5B are end and side cross-sectional views, respectively, illustrating the spline of FIG. 2 being installed (screening not shown), according to the invention.

Figure 6A:
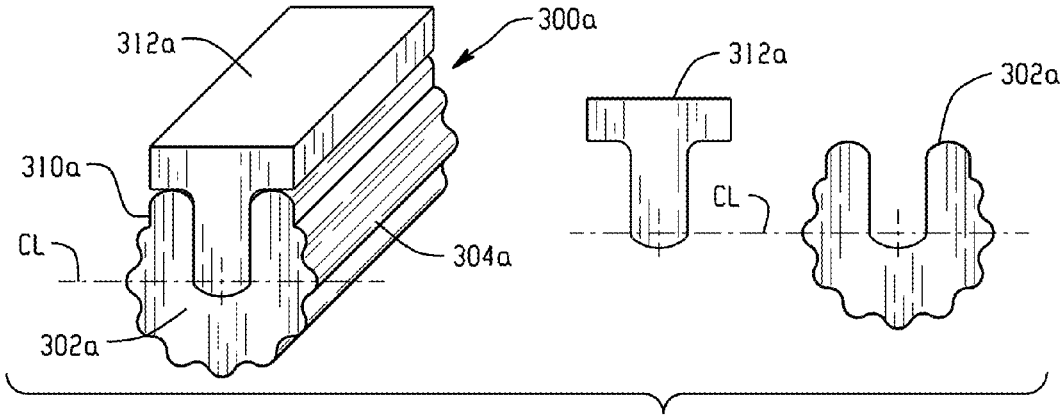
Figure 6B:
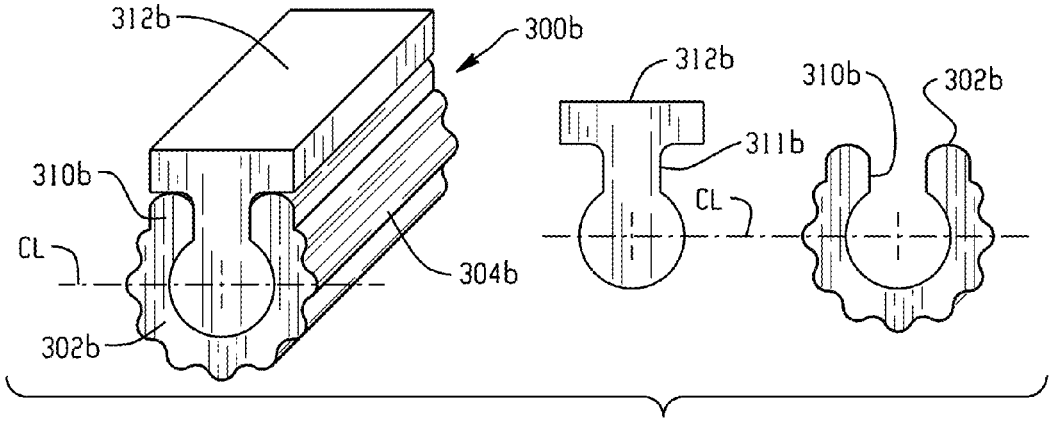

FIGS. 6A and 6B are perspective and end views showing assembly of two variations of a spline implemented in two parts.

Figure 7:
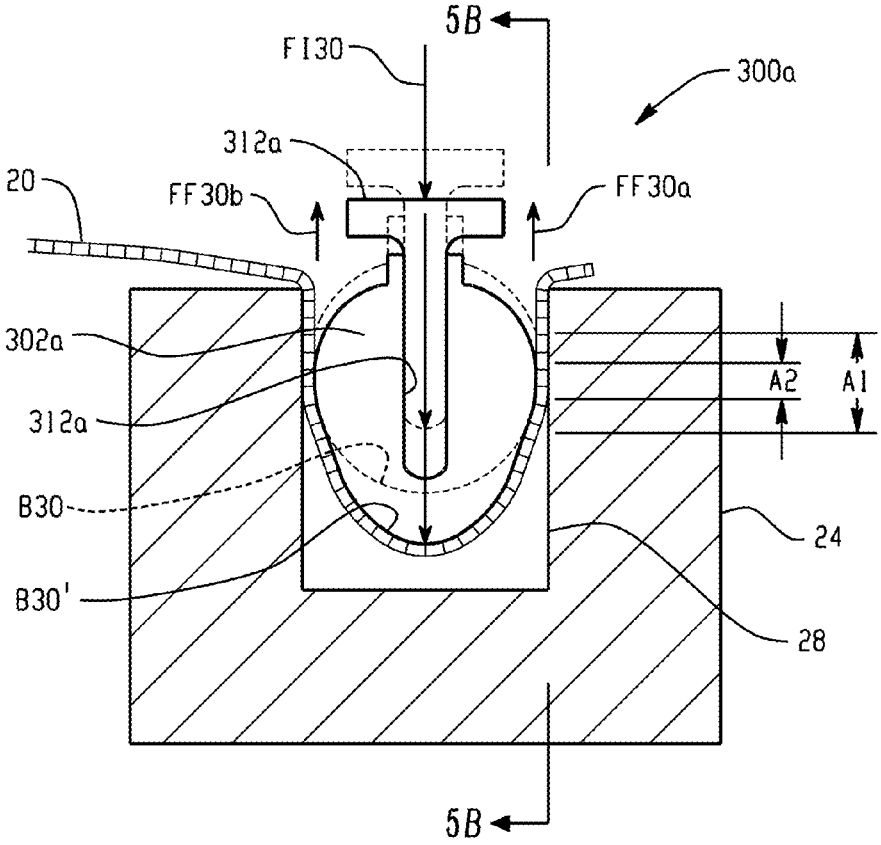

FIG. 7 is an end view illustrating an installation process using the spline of FIG. 6A (screening not shown).

DETAILED DESCRIPTION OF THE INVENTION

The present disclosure may refer to relative directions such as down or left. Such terms should be understood in the context of a referenced drawing and/or to an assumed typical mode for installing splines into the channel of a screen frame, i.e., the frame is laid down on a horizontal work surface with the channel vertically oriented and open on the top. The screen is laid on top, then the spline is held above and along the channel, and is pressed vertically downward into the channel (typically by an installation tool).

A basic concept of the present invention is to re-design the spline to enable a new method of installation in the screen frame channel; in particular replacing the problematic prior art "pizza cutter" narrow roller (less than channel width Wc) with a wide flat roller 162 (width Wr greater than channel width Wc) which is much easier to use. A mallet 164 or any other implement that can deliver a moderate impact to the spline—perhaps even hitting by the heel of a hand may work also, whereas such implements will not install prior art splines adequately (compare FIGS. 4B to 5B).

FIG. 4B illustrates one of the problems with the prior art installation method. The prior art spline body 10 is pushed downward by the round tool 62 which creates a downward force FI10 that is localized to a very small portion of the spline's length. The opposing frictional force FF10 is spread out along the spline 10 to create unbalanced forces that result in a cantilever force that the resilient and flexible spline 10 cannot resist; therefore the spline 10 bends vertically and only the portion under the tool 62 is forced directly downward. The rest of the spline 10 is dragged downward to the extent that longitudinal stiffness can overcome friction drag, and, importantly, also as enabled by stretching Fs of the spline body 10. Since the spline must be resilient to be effective in holding the screening, the stretching effect is significant. As the tool 62 is advanced to the next portion of the spline 10, the stretching effect continues, and the installed portion of the spline 10 remains in a stretched condition. This leads to spline length "growth" during installation, and can also cause sliding of the screening 20 along the channel 28 towards one end of the frame member 24 of the frame 22. Also, the drag that leads to stretch varies according to the degree to which the uninstalled spline ahead of the tool 62 is held down in the channel (i.e., what angle is the spline being held at), compounded by whatever holding force the installer places on the uninstalled spline in order to keep it stretched out straight above and along the channel 28. The amount of residual stretch in an installed prior art spline 10 is therefore unavoidable and likely to vary along the length. A stretched spline is narrower, and therefore exerts less force against the channel walls, which means less frictional gripping force to hold the screening in the channel. Wherever the gripping force is lessened, the screening will tend to pull out a bit, making a wavy line along the frame. Furthermore, any variation in the amount of stretch will create variation in the frictional forces that maintain the stretch. Since the forces will tend to balance out, the screening will be dragged along with longitudinally moving portions of the spline 10 to create puckers in the screen 20.

As schematically shown in FIGS. 2 and 5B, the present improved spline 100 avoids the prior art problems by spreading a localized installation force FI20 more uniformly along the spline 100 by adding a longitudinal (direction L) stiffening element ("plate") 112 connected to the spline body 102 at a joint 108 along the entire length of the spline 100. The plate 112 is made from a stiffer, harder, less resilient material than the body 102 which is made from a soft, resilient material, for example vinyl or PVC like that which is used in prior art splines 10. In an embodiment shown in FIG. 2, the body portion 102 of the improved spline 100 is substantially the same as the prior art spline 10 such as the one illustrated in FIG. 1. This is done to take advantage of the time tested screen holding capabilities of the prior art spline 10. The plate 112 is designed to keep the holding ability of the spline body while adding features to address the installation problems inherent in the prior art spline 10, problems which are caused by the same characteristics that make the prior art spline 10 so good at holding screening in a channel 28.

Thus the body 102 (compare 12) is optimized as a screen holding element by:

- using a soft, resilient material composition, e.g., plastic material 202 that is less than 100 Durometer, preferably about 70-80 Durometer vinyl (or PVC);
- having a body diameter/width Wb that is approximately equal to or slightly greater than the channel width Wc, e.g., 0.145" (inches) for a 0.140" channel width;
- having longitudinally extending ribs 104 (compare ribs 14), preferably including them in the body diameter Wb;
- optionally including a hollow core 106 (compare 16) to add compressibility (however, this may not be preferred for the best distribution of downward force FI20 as seen in FIG. 5A.)

In contrast, the plate 112 is optimized to be a stabilizing element, having characteristics designed to counteract instability during installation such as squirming, twisting, stretching and thinning, and increasing frictional resistance. To accomplish this, first of all we changed the material composition of the plate 112 to a much harder material 212 (e.g., 2 to 3 times harder) than the body material 202. Then the stabilization characteristics are enhanced by dimensional and shape choices. Thus the plate 112 is made from a relatively high Durometer material 212, such as 200 Durometer (generally, it is greater than the soft, resilient 70-80 Durometer vinyl material 202 used for the body 102). Preferably the plate material 212 is UV resistant plastic such as PVC, since this part of the spline 100 will be exposed at the opening of the channel 28. Further, the plate 112 is flat on top (to work with a flat roller) and has enough lateral extent (width Wp from left to right as shown in FIG. 2) to help prevent twisting and squirming of the spline. Preferably the plate is generally rectangular with width Wp and thickness Tp. The width Wp is preferably approximately equal to or less than the channel width Wc. This makes it easy to keep the spline aligned with the channel without the user tending to stretch the spline. Only one hand is needed to hold the spline and the other can use a tool to push it down into the channel. The flat plate 112 on top also helps direct the installation forces FI20 straight downward, especially given the control made possible by pressing a wide flat roller 162 on a relatively wide flat top surface 112. Also, this assures a uniform installation depth for the spline 100 since the wide flat roller 162 (or even a mallet 164) will necessarily stop pushing on the spline when it presses against the face 26 of the frame member 24. An added benefit of a plate 112 such as this is that the flat top will close the channel opening flush with the face 26 of the frame member 24 to make a neat appearance, and this creates a good straightedge for trimming off the free end of screening 20.

FIG. 3 shows a preferred method for making a permanent connection 108 (e.g., fusing the two materials 202 and 212) by co-extruding in a plastics extrusion machine 50. At the extruder outlet 56 the two materials 202 and 212 have been formed into a unitary spline 102 of dual material composition.

The plate 212 provides extra vertical thickness Tp to stiffen the spline 100 against bending in a direction normal to the plate, i.e., vertical bending. As shown in FIG. 5B, this resistance to bending causes a localized vertical force (e.g., a hammer face 164, or even a round roller 162) to be spread out along the length of the spline. The stiffer the spline is, then the further the total force will be spread, and the more uniform the force distribution will be. Thus a greater thickness Tp of the plate 112 augments the high material stiffness to provide more vertical bend stiffness for the whole spline 100.

Consideration is also given to the spline's overall height H. The channel 28 has a depth Dc which is usually sized to stop the spline insertion at a uniform depth, and thus a uniform tension on the screen 20. This may not always be the case, however, and the installer of prior art splines 10 may not push all the way down either. With the presently disclosed spline 100, the plate thickness Tp can be adjusted to set the desired installation depth to the spline height H which may be anywhere up to the channel depth Dc, and uniformity is assured because of the obvious stop when the wide roller 162 hits the face 26 of the frame member 24.

FIG. 2 shows a narrowed neck 110 portion below the rectangular plate 112. The amount of necking should be kept to a minimum in order to take best advantage of the properties of the plate 112, including force distribution as shown in FIG. 5A, and also to prevent rolling of the body 102 by bending the neck 110.

Given the teachings of the present disclosure, a person of ordinary skill in the related arts will likely discern that the herein-disclosed spline improvements are an application of "I-Beam" technology combined with practical considerations regarding the other needed characteristics of a spline for screens, the cost of materials, manufacturing cost, and the like.

In particular, the problem of competing material property requirements is addressed by making the ribs 104 and at least an outer portion of the body 102 (a "cover") from a resilient material that is similar, if not the same as the material(s) commonly used to make the prior art splines; and by making the plate 112 and possibly also the neck 110 and other supporting regions of the body out of a much stiffer material such as, for example, a "hard" plastic.

FIGS. 6A-7 illustrate another way to do this by making a "two part" spline 300 (versions a and b illustrated), with a Tee 312 of rigid material that extends down through the resilient material body 302 to at least the center line (CL) of the body 302. The body 302 isn't permanently connected, but rather it forms a "cover" over the Tee 312 which serves as a backbone and can be a very stiff material even harder and more rigid than the plate material 212. For example it could be an inextensible and only slightly flexible plastic, or even a metal or other material. The body/cover may include a neck portion 310 which would help hold the body 302 on the Tee 312 such as by friction and/or shape (as for the second version 300*b* in FIG. 6B).

Regarding spline installation we first refer to the prior art illustrations in FIGS. 4A-4B. For simplification, ribs 14 and center hole 16 are omitted. When the prior art spline 10 is pushed downward, friction between the spline and the channel's vertical walls 28 opposes the downward installation force FI10. Since the entire spline is resilient, the frictional upward force (FF10*a*+FF10*b*) is parallel to, but not in line with the downward force which is applied to the middle of the cross-sectionally round body 12 (profile B10). The friction force is applied to the laterally-offset sides of the round cross-section to produce a double-shear effect. In order to transfer enough downward force from the middle to the outside edges of the spline, the body compacts until it becomes rigid enough to transfer sufficient downward force to the sides. The compaction changes the body shape from the original round shape B10 (dashed line) to a laterally oblong shape B10'. Unfortunately, compacting the round spline by applying force FI10 to the top of the body 12 causes the body material to push outwards, thereby increasing the friction that it is trying to oppose. Also the friction is further increased by increased contact area (from A1 to A2) as more of the body material is pushed outward to spread out against the unyielding channel walls. All of this makes installation of the prior art spline very difficult and therefore more likely to be non-uniform. To reduce the negative effects, the prior art spline body diameter is very close to the channel wall spacing, and the ribs (not shown) are made very thin. But making these accommodations means lessening the gripping force that is intended to hold the screen in the channel—the gripping force being frictional resistance against pulling the screen upward. This upward "pull-out" force by the screening is one-sided (i.e., like FI10*b* without FI10*a* but in opposite direction and also reduced magnitude), causing the spline to roll, and is applied tangential to the spline body, opposed to, but directly in line with the frictional force, thereby maximizing its efficacy. Thus the "grip" is limited to whatever friction can be generated on one side of the spline by the outward restoration force of the laterally compressed spline. Unlike when it is being pushed in, the spline being pulled out is no longer vertically compressed from above. Since the gripping (pull-out) force can only be increased by increasing friction (e.g., by increasing the spline/body diameter), and since the installation method magnifies the effects of friction to make installation more difficult, the net result is that it will always be easier to remove the spline and screen than it is to install it. Any effort to improve the gripping strength will automatically make installation more problematic and more likely to be defective due to non-uniformities along the length of the spline and channel.

The improved spline 100 directly addresses most of these problems, in effect turning the equations on their heads, making it easier to install while at the same time improving its grip on the screening 20.

Referring now to the invention illustrations in FIGS. 5A-5B, when the dual composition spline 100 is pushed downward, friction between the body and the channel's vertical walls opposes the downward installation force FI20. Since the body 102 is resilient, the frictional upward force (FF20*a*+FF20*b*), applied to the area A1 where the outermost sides of the body 102 (profile B20) are pressed against the walls, is parallel to the downward force FI20 which is applied to the whole body 102. The friction force is applied to the laterally-offset sides of the body 102 to produce a double-shear effect. The relatively rigid plate 112 distributes the downward force FI20 fairly evenly across the width of the body 102 (although slightly less at the sides depending upon how much neck 110 is present). Thus the force is directed mostly downward, not leaving much to push laterally outward toward the contact area A1 where the frictional forces exist. As a result, the body 102 is compressed as a column until it overcomes the body material's resilience enough to transfer sufficient downward force to the sides (by pulling on them). This changes the body shape from the original round (or flattened round) shape B20 (dashed line) to a vertically elongated shape B20'. Although the contact area may stay the same or possibly decrease (from A1 to A2) the lateral forces are not significantly increased. All of this makes installation of the inventive spline less difficult than the prior art, and therefore more likely to be uniform.

Unlike before, since the gripping (pull-out) force is increased by increasing friction (e.g., by increasing the spline/body diameter), and since the installation method diminishes the effects of friction to make installation less difficult, the net result is that the gripping strength can be improved without as much concern about the impact on installation and resultant quality.

So the new spline design 100 creates a new, improved design space. For example, the spline body width Wb can be increased compared to the prior art, thereby improving gripping strength. For example, the body can be made stiffer (higher spring constant—restorative force—under compression) by changing the body material 202, and/or changing the rib 104 profile to be wider and shorter. Wider/shorter ribs can be used because we no longer need the ribs to bend out of the way during installation. Instead they will be temporarily stretched to flatten out during installation, then will spring back for holding.

Another very significant improvement comes from the presence of the wide plate 112, and preferably almost as wide neck 110. Regardless of width in fact, the oblong shape provided by the plate and neck prevents or severely limits rolling of the spline (body 102) when the screening is trying to pull itself out of the channel. When the spline is prevented from rolling, then the pull-out resistance (gripping force) essentially doubles because it becomes two sided rather than one (FF20*a*+FF20*b* in opposite direction). In fact it could even increase to be greater than the resistance to installation because the plate 112 will be rolled over, and pressed against, the outer channel wall to increase the frictional contact area A1 on that side; and, the harder the screen is pulled, the harder the plate is pressed against the wall, also increasing friction. Furthermore, when the screening is pulling upward, the force is applied to the bottom of the spline body, compressing it rather than stretching it—again this increases frictional resistance, making pull-out more like trying to push in the prior art spline 10.

Finally, it should be noted that many of the advantages described for the dual composition spline 100 are at least partly present even if the spline shape shown in FIG. 2 is made with only a single material composition. For example, the outward force that increases friction in the prior art installation is lessened by using the improved spline with a neck almost as wide as the body because the downward force is now spread across the width of the spline. For example, the extra material in the neck and plate area increases vertical bend stiffness and reduces the tendency to stretch, twist or roll. For example, the fat neck prevents rolling of the spline, thereby increasing the gripping strength.

Another advantage of the disclosed spline embodiments is due to the plate 112. Once the spline 100 is installed deep enough to make the plate 112 flush with the frame's top surface 26, the installer will know to stop pushing (or pounding) wherever that is true, and will know where more force is still needed (where the plate is not flush). The result is installation to a constant, uniform depth. The appearance will be nicely finished also. Alternatively, the uniform depth is also assured if the plate 112 is made wider than the channel width Wc. Then the spline 100 is installed until the plate 112 is stopped on the frame face 26.

Although the invention has been illustrated and described in detail in the drawings and foregoing description, the same is to be considered as illustrative and not restrictive in character—it being understood that the embodiments shown and described have been selected as representative examples including presently preferred embodiments plus others indicative of the nature of changes and modifications that come within the spirit of the invention(s) being disclosed and within the scope of invention(s) as claimed in this and any other applications that incorporate relevant portions of the present disclosure for support of those claims. Undoubtedly, other "variations" based on the teachings set forth herein will occur to one having ordinary skill in the art to which the present invention most nearly pertains, and such variations are intended to be within the scope of the present disclosure and of any claims to invention supported by said disclosure.

What is claimed is:

1. A spline for screen framing, wherein a frame has a longitudinal channel in the face of a frame member, the channel having an open top of width (Wc), whereby a portion of screen is removably held within the channel by a spline; the spline comprising:

an elongated member having a longitudinally extending holding portion connected along its length to an adjacent longitudinally extending stabilizing portion; wherein the spline is configured for use in a longitudinal channel having generally straight vertical sides of the same width (Wc) as the open top;

the holding portion has a generally circular cross section and is resiliently compressible laterally across its width (Wb), and the stabilizing portion is positioned and shaped as a flat top plate of the spline, being longitudinally straight and planar for use with an installation tool that has a widthwise-flat pushing face, by presenting a flat surface on top of the spline relative to the channel depth, thereby assuring straight vertical insertion of the spline into the channel during installation.

2. The spline of claim 1, further wherein:

the stabilizing portion has a top plate width (Wp) configured for closing the open top of the channel flush with the face of the frame member when the spline is fully installed.

3. The spline of claim 2, further wherein:

the top plate width (Wp) is less than the channel top width (Wc), being configured for use with an installation tool that has a pushing face wider than the channel top width (Wc), thereby indicating full installation when the installation tool contacts the face of the frame member while pressing the spline into the channel.

4. The spline of claim 1, further wherein:

the stabilizing portion is further configured for counteracting instability during spline installation wherein the instability comprises squirming, twisting, rolling, stretching, thinning, and vertical bending, by having a generally rectangular cross section that provides extra vertical thickness above the spline holding portion, thereby stiffening the spline.

* * * * *